US005906664A

United States Patent [19]

Basu et al.

[11] Patent Number: 5,906,664

[45] Date of Patent: May 25, 1999

[54] FUELS FOR DIESEL ENGINES

[75] Inventors: Arunabha Basu, Naperville, Ill.; Theodore H. Fleisch, Houston, Tex.; Christopher I. McCarthy, Naperville, Ill.; Svend-Erik Mikkelsen, Gentofte, Denmark; Carl A. Udovich, Joliet, Ill.

[73] Assignee: Amoco Corporation, Chicago, Ill.

[21] Appl. No.: 09/048,397

[22] Filed: Mar. 26, 1998

Related U.S. Application Data

[63] Continuation-in-part of application No. 08/463,939, Jun. 5, 1995, which is a continuation of application No. 08/289,933, Aug. 12, 1994, abandoned.

[51] Int. Cl.[6] ..... C10L 1/02; C10L 1/10

[52] U.S. Cl. ..... 44/446; 44/326; 44/436; 44/457

[58] Field of Search ..... 44/448, 446, 451, 44/326, 436, 457

[56] References Cited

U.S. PATENT DOCUMENTS

| | | | |
|---|---|---|---|
| 2,708,922 | 5/1955 | Neely | 44/448 |
| 3,846,088 | 11/1974 | Brown et al. . | |
| 4,341,069 | 7/1982 | Bell et al. | 60/39.02 |
| 4,422,412 | 12/1983 | Norton | 123/3 |
| 4,518,395 | 5/1985 | Petronella | 44/53 |
| 4,603,662 | 8/1986 | Norton et al. | 123/1 |
| 4,682,984 | 7/1987 | Epler | 44/56 |
| 4,892,561 | 1/1990 | Levine | 44/51 |
| 5,177,114 | 1/1993 | Van Dijk et al. | 518/703 |

FOREIGN PATENT DOCUMENTS

| | | |
|---|---|---|
| 654470 | 12/1937 | Germany . |

*Primary Examiner*—Margaret Medley
*Attorney, Agent, or Firm*—Frederick S. Jerome; Thomas A. Yassen; Robert E. Sloat

[57] ABSTRACT

The invention relates to high energy, oxygenated fuel compositions suitable for use in compression ignition internal combustion engines which fuel compositions contain a synergistic combination of dimethyl ether, methanol, and water, the combination providing a single liquid phase with good ignition characteristics. More particularly fuels comprising from about 72 to about 95 weight percent of dimethyl ether, from about 0.1 to about 20 weight percent of methanol, and from about 0.1 to about 20 weight percent of water are disclosed.

6 Claims, 3 Drawing Sheets

FUELS FOR DIESEL ENGINES

CROSS-REFERENCE TO RELATED APPLICATIONS

This application is a continuation-in-part of U.S. patent application Ser. No. 08/463,939 filed Jun. 5, 1995, which is a continuation of U.S. patent application Ser. No. 08/289,933 filed Aug. 12, 1994, now abandoned, which applications are specifically incorporated herein, each in its entirety, by reference.

FIELD OF THE INVENTION

This invention relates to improved fuels for compression ignition internal combustion engines. More particularly, this invention relates to high energy, oxygenated diesel fuel compositions which contain a synergistic combination of dimethyl ether, methanol, and water.

BACKGROUND OF THE INVENTION

It is well known that internal combustion engines have revolutionized transportation following their invention during the last decades of the 19th century. While others, including Benz and Dailmer, invented and developed engines using electric ignition of fuel such as gasoline, Rudolf C. K. Diesel invented and built an engine named for him which employs compression for autoignition of the fuel in order to utilize low-cost organic fuels. Development of improved diesel engines for use in automobiles has proceeded hand-in-hand with improvements in diesel fuel compositions which are today typically derived from petroleum. Modern high performance diesel engines demand ever more advanced specification of fuel compositions, but cost remains an important consideration.

As alternatives to conventional hydrocarbon diesel fuel produced by refining petroleum, other liquid fuels obtained by the conversion of methane or coal have been under consideration since the 1920's. Methanol has been proposed as one such alternative fuel for internal combustion engines. Methanol is usually manufactured from carbon monoxide and hydrogen, which have historically been obtained in large volume from either natural gas or coal. Carbon monoxide can also be obtained from almost any carbon-containing substance, including agricultural and forest products and many waste materials. The large supply and wide distribution of raw materials for manufacturing methanol is responsible to a large degree for its growing use as a fuel for internal combustion engines. However, methanol has a very low heating or BTU value. Thus, the performance of an internal combustion engine declines considerably when methanol is employed as the fuel. By contrast, relative to methanol, dimethyl ether has a higher BTU value and is non-toxic. In addition, dimethyl ether is a clean-burning fuel whose combustion gases are essentially free of solid particles.

German Patent Number 654,470 (Dec. 20, 1937) to Otto Gross Wanne-Eickel describes mixtures of methanol and dimethyl ether containing from 5 percent to 45 percent methanol (and hence from 95 percent to 55 percent dimethyl ether) as being a suitable fuel to meet increasing fuel needs for internal combustion engines. Existing amounts of fuel available from petroleum were not sufficient at that time to meet such increasing fuel needs. Selection of dimethyl ether with a limited methanol content, instead of pure methanol, is said to be desirable because the specified mixtures can be used, generally, to fuel internal combustion motors without causing the considerable loss in performance of such motors using pure methanol for fuel. The patent also states, however, dimethyl ether itself has such a strong tendency to cause knocking in spark ignition motors that is not possible to achieve normal operation. No working examples or other supporting data are provided in this 1937 German patent.

Numerous methods have been disclosed for the production of dimethyl ether in combination with methanol and water from synthesis gas obtained from various sources, such as natural gas, coal or essentially any carbon-containing substance. Bell et al., U.S. Pat. No. 4,341,069; Van Dijk et al., U.S. Pat. No. 5,177,114; and published European Patent Applications Numbers 0324475 and 0409086 A1 are examples of such disclosures. In particular, European Patent Applications Numbers 0324475 and 0409086 A1 disclose how process conditions can be controlled in one such method in order to produce various mixtures of dimethyl ether and methanol having a wide range of mole ratios of dimethyl ether to methanol.

In numerous methods for the manufacture of dimethyl ether, dimethyl ether is produced in a product mixture that also contains methanol and/or water. Furthermore, removal of methanol and water from dimethyl ether in such a product mixture requires additional processing steps. Thus, it would be highly desirable to be able to employ mixtures of dimethyl ether, methanol and water—or, in other words, crude or unpurified dimethyl ether—directly as diesel fuels in order to avoid the aforesaid additional processing steps associated with purifying crude dimethyl ether and, ideally, so that process conditions could be employed in order to produce such mixtures directly from synthesis gas. In that way it would be possible to avoid or at least minimize the need for additional processing steps, such as purification steps, and still produce a highly effective and economical alternative diesel fuel.

U.S. Pat. No. 4,422,412 to John H. R. Norton describes modification of a compression ignition engine (diesel) to pass a portion of a methanol fuel stream directly into a cylinder of the engine and divert a portion of the methanol fuel stream to catalytic conversion of the diverted methanol to dimethyl ether and water in a reactor whose outlet is in communication with the same cylinder. The combined gaseous mixture in the cylinder is up to about 50 percent by weight, preferably from about 5 to 30 percent by weight dimethyl ether. Stoichiometry of this methanol conversion requires molar amounts of dimethyl ether and water formed to be equal. Therefore, a balance of the combined gaseous mixture in the cylinder is at least about 31.6 percent methanol (50 percent dimethyl ether, 18.4 percent water), and preferably about 58.9 to 93.2 percent methanol.

U.S. Pat. No. 4,603,662 to John H. R. Norton and Peter R. Rebello describes a fuel composition that contains a mixture of at least one ether and at least one alcohol, and optionally may contain water, normal diesel fuel, and cetane improvers. For use in a compression ignition engine the patent states that, generally, from 5 to 80 percent by volume, more usually from 5 to 20 percent by volume of fuel may be ethers. The fuel may contain small amounts of lubricants, e.g. up to about 2 percent by volume (more generally about 1 percent by volume) of an oil such as castor oil. Dimethyl ether and methanol is described as a convenient fuel because dimethyl ether is soluble in methanol (without water) at room temperature and pressures. U.S. Pat. No. 4,603,662 specifically illustrates fuels containing: (a) 5 percent of dimethyl ether by volume and 95 percent of methanol with and without an additional 1 percent of castor oil in Examples 1 and 3; and (b) 20 percent of dimethyl ether and 80 percent of methanol or 78 percent of dimethyl ether and 2 percent castor oil and as in Example 5.1.

Levine, U.S. Pat. No. 4,892,561, describes a first diesel fuel composition free of methanol that contains 95–99.9 percent by weight of dimethyl ether and 0.1–5 percent by weight of a cetane number-improving additive such as water. Addition of water to dimethyl ether, forming a mixture rather than a compound, is said to avoid formation of toxic methanol. This patent also discloses a second diesel fuel composition that contains at least 50 percent by weight of the aforesaid first diesel fuel and the remainder conventional hydrocarbon diesel fuel.

However, thus far, there has not been a disclosure of the compositions of mixtures of dimethyl ether, methanol and water that contain the balance of concentration levels of dimethyl ether, methanol and water necessary for the resulting diesel fuel to afford both environmental benefits and good ignition characteristics, that can be produced economically without the need for costly purification steps, and that can be maintained as a stable single liquid phase both in use and during storage.

It is therefore a general object of the present invention to provide an improved alternative diesel fuel composition which overcomes the aforesaid problems and affords the aforesaid benefits.

More specifically, it is an object of the present invention to provide an improved alternative diesel fuel composition that has a high BTU value.

It is another object of the present invention to provide an improved alternative diesel fuel composition that is a clean burning material whose overall emissions are lower and whose combustion gases are essentially free of solid particles.

It is a further object of the present invention to provide an improved alternative diesel fuel composition that affords good ignition characteristics.

It is another object of the present invention to provide an improved alternative diesel fuel composition that can be produced economically without the need for costly purification steps.

It is an additional object of the present invention to provide an improved alternative diesel fuel composition that is maintained in a stable single liquid phase both in use and during storage.

Other objects and advantages of the present invention will become apparent upon reading the following detailed description and appended claims.

SUMMARY OF THE INVENTION

These objects are achieved by an improved, high energy, oxygenated fuel composition suitable for use in compression ignition internal combustion engines comprising dimethyl ether, methanol, and water, wherein the percentages thereof, based upon the total weight of dimethyl ether, methanol, and water present, fall within the trapezoidal region delineated on the attached triangular phase diagram of FIG. 1.

For a more complete understanding of the present invention, reference should now be made to the embodiments illustrated in greater detail in the accompanying drawings and described below by way of examples of the invention.

BRIEF DESCRIPTION OF THE DRAWINGS

The appended claims set forth those novel features which characterize the present invention. The present invention itself, as well as advantages thereof, may best be understood, however, by reference to the following brief description of preferred embodiments taken in conjunction with the annexed drawings, in which:

BRIEF DESCRIPTION OF THE INVENTION

Figure 1:
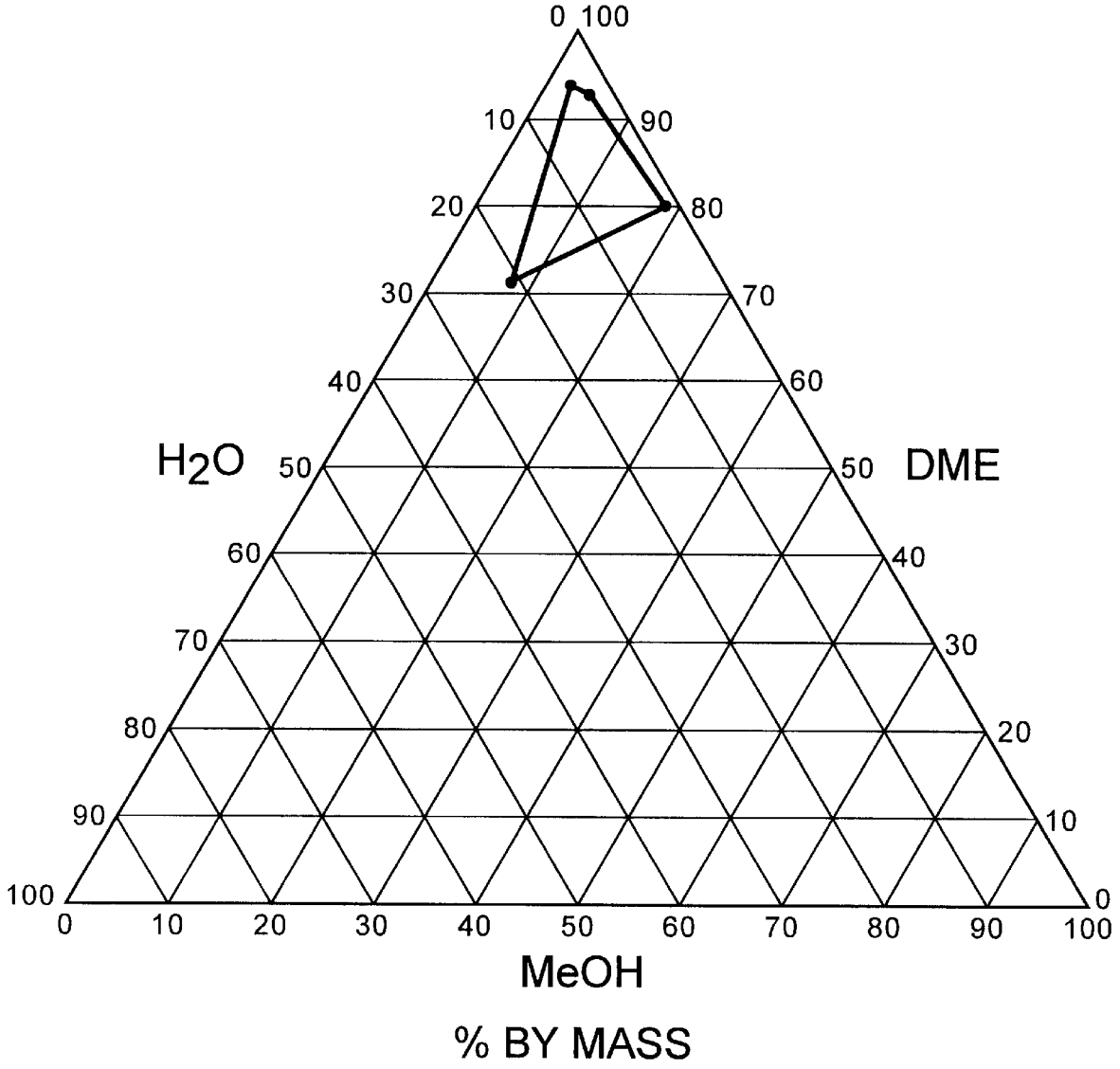
FIG. 1 is a compositional diagram in which the trapezoidal region delineated therein corresponds to fuel compositions of the present invention which comprise dimethyl ether, methanol, and water.

Some of the preferred, high energy, oxygenated fuel compositions which combine the above mentioned outstanding properties are plotted in the triangular composition diagram FIG. 1. The trapezoidal region delineated in the diagram corresponds to fuel compositions of the present invention. Coordinates for each point of this region define a fuel in terms of percentages of dimethyl ether (e), methanol (m), and water (w), based upon the total weight of dimethyl ether, methanol, and water present. The region is substantially bounded by the shortest line circumscribing coordinate points—(80, 18), (72, 8), (94, 3), and (92, 4)—where the coordinates are e percent of dimethyl ether, and m percent of methanol.

Preferred percentages e, m, and w are depicted in the trapezoidal region delineated in the diagram and have the following approximate ranges: about 72 to about 95 weight percent of dimethyl ether, from about 0.1 to about 20 weight percent of methanol, and from about 0.5 to about 20 weight percent of water. While it is difficult to calculate a numerical range for the percentages, for convenience the following limits are given. Particularly, when w is in the range upward from about 5.2 to about 20 in the present invention, the lowest concentration of methanol in weight percent (min. meth. conc.) that is permitted in the diesel fuel composition containing a given water concentration in weight percent (water conc. w) is defined by the relationship, $$\text{min. meth. conc} = 0.5\ w - 2.6,$$

and the largest concentration of methanol in weight percent (max. meth. conc.) that is permitted in the diesel fuel composition containing the given water concentration in weight percent (w) is defined by the relationship, $$\text{max. meth. conc.} = 20 - 0.6\ w.$$

If the alternative diesel fuel composition of the present invention contains less than about 70 weight percent of dimethyl ether, the problems of poor ignition characteristics and of separation of the diesel fuel into two liquid phases result and prohibit the composition from being used effectively as a diesel fuel.

Water is present in the alternative diesel fuel composition of the present invention at a level of from about 0.1 weight percent, preferably from about 1 weight percent, more preferably from about 2 weight percent, up to about 20 weight percent, preferably up to about 10 weight percent. If the composition of the present invention contains more than about 5.2 weight percent of water in admixture with dimethyl ether alone, it will separate to form two liquid phases unless methanol is also present.

Within limits to be described hereinbelow, the presence of certain amounts of methanol in the mixture of dimethyl ether and water stabilizes the mixture against separation into two liquid phases. The amount of methanol that is necessary to provide this stabilization increases as the concentration of water in the mixture with dimethyl ether increases. However, if too much methanol is present in the mixture containing a particular concentration of water, the ignition characteristics of the mixture are adversely affected. Thus, for a mixture of dimethyl ether with a given concentration of water, the concentration of methanol in such mixture must be at least a certain minimum level in order to prevent phase separation and must be below a certain maximum level in order to avoid poor ignition characteristics.

The specific maximum and minimum concentrations of methanol in the mixture depend on and vary with the particular water concentration in the mixture. The minimum concentration of methanol in weight percent (min. meth. conc.) in the diesel fuel depends on the water concentration therein in weight percent (w) and is determined by the approximate relationship min. meth. conc=0.5 w−2.6.

The maximum concentration of methanol in weight percent (max. meth. conc.) in the diesel fuel containing a given water concentration is determined by the approximate relationship max. meth. conc.=20−0.6 w.

Both of these approximate relationships were determined empirically based on actual measurements of ignition characteristics and phase separations using a significant number of different mixtures of dimethyl ether, methanol and water.

As these relationships indicate, it is not necessary that methanol be present in the alternative diesel fuel composition of the present invention unless the fuel composition contains at least 5.2 weight percent of water. In addition, the maximum concentration of methanol that can be present in the alternative diesel fuel composition of the present invention under any circumstance is about 20 weight percent. Furthermore, when the alternative diesel fuel composition of the present invention contains about 20 weight percent of water, the fuel composition must also contain at least 7.4 weight percent of methanol in order to prevent phase separation but must not contain more than 8 weight percent of methanol, otherwise poor ignition characteristics result. This range of effective methanol concentration is so narrow that for all practical purposes, the upper limit of the concentration of water that may be present in the alternative diesel fuel composition of the present invention is about 20 weight percent.

In another preferred embodiment, if it is desirable to improve the ignition characteristics of the alternative diesel fuel composition of this invention, any convenient conventional cetane number-improving additive can be added to the diesel fuel composition in cetane number-improving amounts. Examples of suitable cetane number-improving additives include inorganic peroxides such as hydrogen peroxide, organic peroxides such as ethyl t-butyl peroxide and di-t-butylperoxide, and alkyl nitrates such as ethyl hexyl nitrate, amyl nitrate, and nitromethane. More specifically, the cetane number-improving additive is employed at a concentration in the diesel fuel composition in the range of preferably from about 0.01, more preferably from about 0.05, preferably to about 3 weight percent, more preferably to about 1 weight percent.

In an additional preferred embodiment, the alternative diesel fuel composition of this invention can additionally comprise up to 50 weight percent of either a conventional hydrocarbon diesel fuel, preferably derived from petroleum, or a biodiesel fuel derived from plants and vegetables.

EXAMPLES OF THE INVENTION

The following Examples will serve to illustrate certain specific embodiments of the herein disclosed invention. These Examples should not, however, be construed as limiting the scope of the novel invention as there are many variations which may be made thereon without departing from the spirit of the disclosed invention, as those of skill in the art will recognize.

A QWF thick walled glass cylinder with a volume of 50 mL and a first blind end and a second open end was used in these tests. The open end was coupled to a stainless steel plate using an O-ring as sealing material. The removable stainless steel plate was supplied with an on/off valve and connected to a ⅛ inch flexible tube. The weight of this equipment was determined by an electronic balance.

EXAMPLE 1

Water and Dimethyl Ether

In this series of experiments solubility of water in neat dimethyl ether (DME, 99.99 percent by weight) was determined. Water was first added to the glass cylinder. Weight of water added was determined by electronic balance. The vapor space in the glass cylinder was then purged at ambient pressure with gas phase DME at ambient temperature (about 22° C.). The purge was approximately 5 times the volume of the cylinder and purge time was approximately 20 seconds. Weight of the cylinder's contents was recorded.

Liquid DME was added by opening the bottom of the DME supply cylinder and the on/off valve at the stainless steel plate on the glass cylinder. The amount of DME entering the cylinder was selected manually. The flexible tube was removed and the specific amount of DME added was determined using the balance and subtracting the amount of water.

The physical state of the contents was noticed visually. The physical behavior of the liquid was either one liquid phase or two liquid phases. More neat DME was added to the glass cylinder and the actual ratio of water and DME was determined by the balance. The number of phases were visually determined and noted. It was determined that the maximum measured amount of water soluble in DME and maintaining one homogenous phase at ambient temperature was 5.5 percent by weight.

EXAMPLE 2

Water, Dimethyl Ether and Methanol

In this series of experiments physical phase conditions of mixtures of water, dimethyl ether and methanol were determined using the same equipment and procedures as in Example 1. A known mixture of water and methanol was introduced into the cylinder. Amount of water and methanol was determined by electronic balance. The DME purge was subsequently performed. Addition of DME was performed step by step and, between additions of DME, the number of phases noted.

Figure 2:
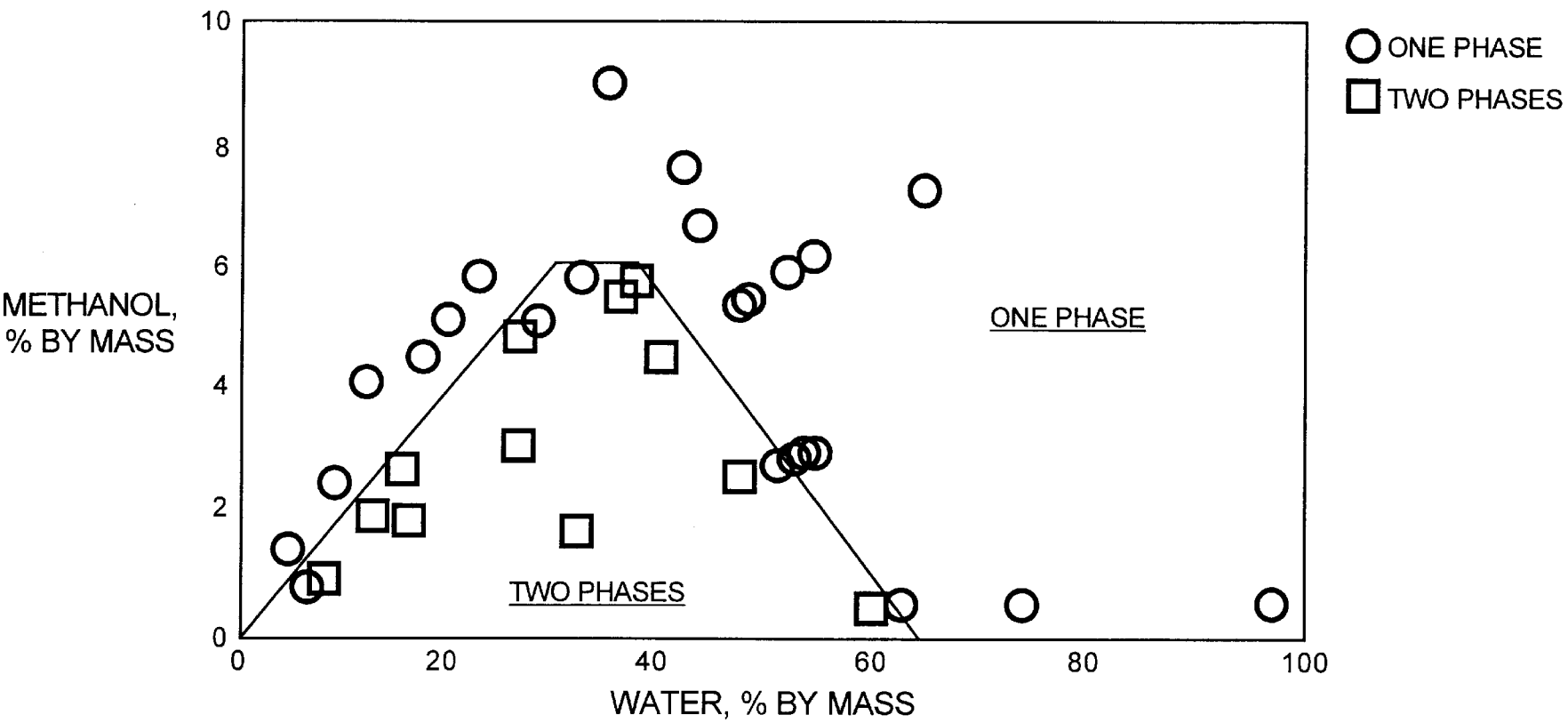
FIG. 2 is a rectangular phase diagram in which a deleterious two phase region is delineated for mixtures of dimethyl ether, methanol, and water.

FIG. 2 is a rectangular phase diagram of the data in which a deleterious two phase region is delineated -for mixtures of dimethyl ether, methanol, and water. Squares denote experimental mixtures with two separate liquid phases plus a vapor phase. Circles denote experimental mixtures containing only one liquid phase plus a vapor phase. Solid lines indicating compositions at the boundary between the one and two phase regions were determined by statistical analysis of the data.

EXAMPLE 3

Ignition Quality

Several of the above described mixtures containing various amounts of water, DME, and methanol were tested as fuels in a diesel engine. Fuel mixtures were prepared in 1 liter batches and tested in a Yanmar single cylinder 0.273 diesel engine (YDG 3000). Injector opening pressure was 100 bar, and the engine was started at ambient temperature (about 22° C.) at each experiment. The engine was in operation at idle and loads of 50 percent and 100 percent. The engine was tested with the fuels identified in Table I.

TABLE I

| Test No. | DME | MeOH | Water | Ignition |
|---|---|---|---|---|
| 1 | 100.0 | 0.0 | 0.0 | OK |
| 2 | 94.5 | 0.0 | 5.5 | OK |
| 3 | 92.0 | 4.0 | 4.0 | OK |
| 4 | 90.0 | 8.0 | 2.0 | OK |
| 5 | 82.0 | 8.0 | 10.0 | OK |
| 6 | 81.0 | 19.0 | 0.0 | Limit |
| 7 | 72.0 | 8.0 | 20.0 | OK |
| 8 | 47.0 | 53.0 | 0.0 | NO |
| 9 | 34.0 | 33.0 | 33.0 | NO |
| 10 | 10.0 | 90.0 | 0.0 | NO |

Figure 3:
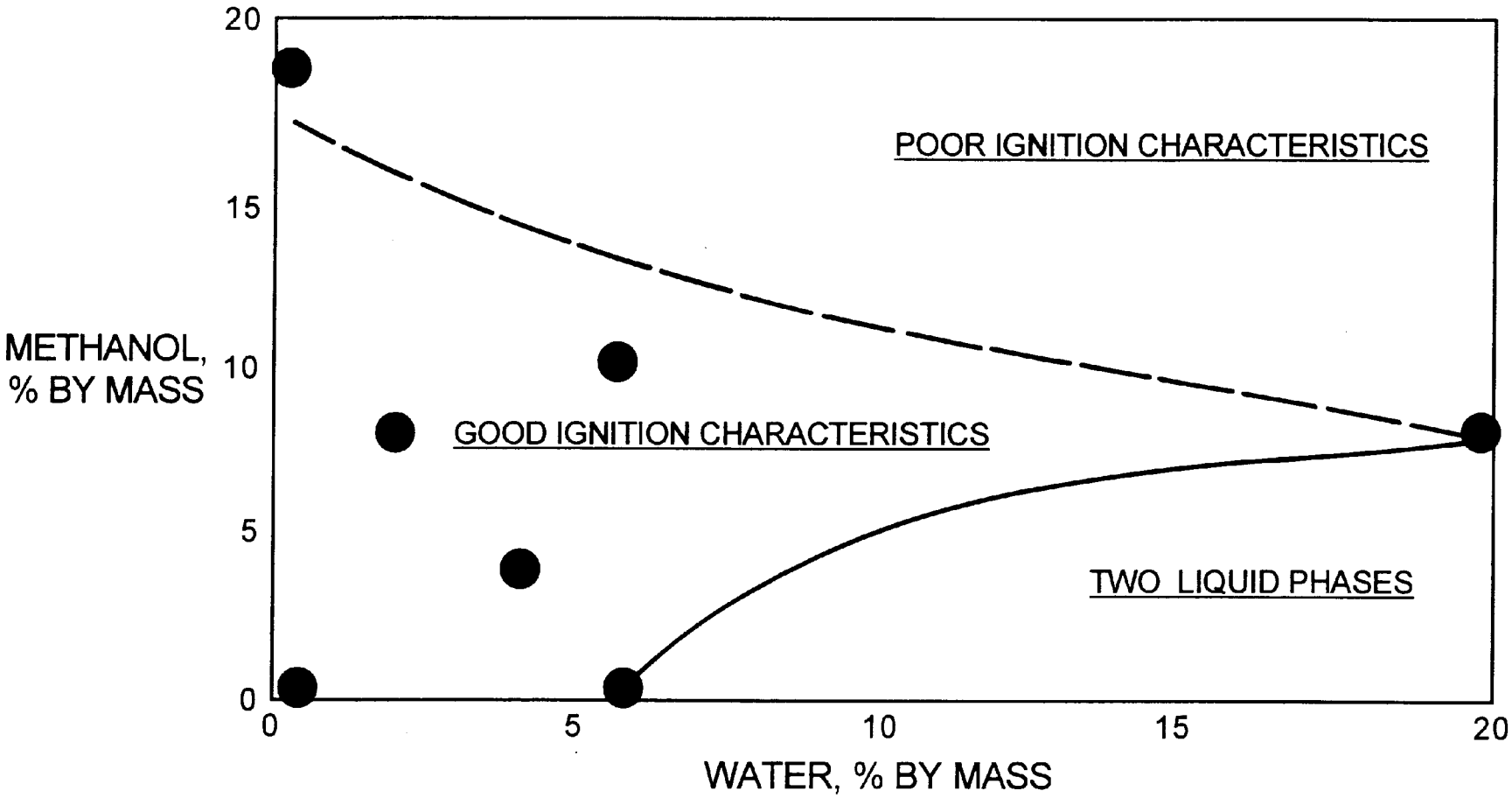
FIG. 3 is a rectangular phase diagram in which a critical region of compositions having good ignition characteristics is delineated outside the deleterious two phase region.

Data in Table I illustrate that fuel compositions set forth in test numbers 1 to 5, inclusive, and 7, experienced ignition after a few revolutions without use of any starting aids. These fuels also achieved smooth operation at idle and loads of 50 percent, and 100 percent. No ignition was achieved using the fuel compositions set forth in test numbers 8 to 10, inclusive. FIG. 3 is a rectangular phase diagram in which a critical region of compositions of methanol and water in DME having good ignition characteristics is delineated outside the deleterious two phase region.

EXAMPLE 4

The present invention will be more clearly understood from the following specific example. A diesel fuel composition containing 94 weight percent of dimethyl ether, 3 weight percent of water, and 3 weight percent of methanol was tested in a Navistar T 444E diesel engine having a 90 degree V-8 with a displacement of 444 cubic inches, a bore diameter of 4.11 inches, and a stroke of 4.18 inches. The diesel engine was a turbocharger equipped with an air-to-air intercooler and an electronically controlled direct injection fuel system and was fitted with an exhaust gas recirculation system. For this testing, since more DME has to be injected to achieve the same power output as conventional hydrocarbon diesel fuel, slightly oversized injectors were used. In addition, due to the higher volatility of the dimethyl ether-containing composition tested, a modified feed pump was employed in order to prevent fuel cavitation in the injector. The engine test was performed using an 8-mode steady-state test cycle that simulates the U.S. EPA transient test cycle. The following exhaust emissions were measured: hydrocarbons, carbon monoxide; nitrogen oxides, smoke and particulates.

Test results indicate that the consumption of the dimethyl ether-containing composition was substantially equal to that of conventional diesel fuel when the emission level was 5 gm/bhp-hr of nitrogen oxides and was significantly lower than that of conventional diesel fuel when the emission level was less than 3.64 gm/bhp-hr of nitrogen oxides. The level of nitrogen oxides emissions was only about 1.7 gm/bhp-hr which is a significant improvement over the level of nitrogen oxides emissions of pure dimethyl ether alone. The soot content of the emissions was only about 0.03 gm/bhp-hr, and the level of hydrocarbon emissions was about 0.3 gm/bhp-hr which is only slightly above that of pure dimethyl ether alone. The combination of (1) the sum of the levels of nitrogen oxide and hydrocarbon emissions of about 2.1 gm/bhp-hr, and (2) the level of particulates in the emissions of about 0.034 gm/bhp-hr measured in this test is already within the upper limits therefor of 2.5 gm/bhp-hr and 0.05 gm/bhp-hr, respectively, mandated by the California ULEV, which will not go into effect until 1998.

From the above description, it is apparent that the objects of the present invention have been achieved. While only certain embodiments have been set forth, alternative embodiments and various modifications will be apparent from the above description to those skilled in the art and are considered equivalent and within the spirit and scope of the invention.

For the purposes of the present invention, "predominantly" is defined as more than about fifty percent. "Substantially" is defined as occurring with sufficient frequency or being present in such proportions as to measurably affect macroscopic properties of an associated compound or system. Where the frequency or proportion for such impact is not clear, substantially is to be regarded as about twenty per cent or more. The term "essentially" is defined as absolutely except that small variations which have no more than a negligible effect on macroscopic qualities and final outcome are permitted, typically up to about one percent.

Examples have been presented and hypotheses advanced herein in order to better communicate certain facets of the invention. The scope of the invention is determined solely by the scope of the appended claims.

Having described the invention, that which is claimed is:

1. A high energy, oxygenated diesel fuel composition suitable for use in compression ignition internal combustion engines consisting of dimethyl ether, from 3 to 8 weight percent of methanol, and from 2 to 20 weight percent of water.

2. The fuel composition of claim 1 consisting of from about 85 to about 93 weight percent of dimethyl ether.

3. The fuel composition of claim 1 consisting of from 2 to about 10 weight percent of water.

4. A diesel fuel composition consisting of dimethyl ether, from 3 to 8 weight percent of methanol, from 2 to 20 weight percent of water and from 0.01 to 1 weight percent at least one cetane number-improving additive selected from the group consisting of inorganic peroxides, organic peroxides, and alkyl nitrates.

5. A diesel fuel composition suitable for use in compression ignition internal combustion engines consisting of from 5 to 50 weight percent of a conventional hydrocarbon diesel fuel or a biodiesel fuel derived from plants or vegetables and the diesel fuel composition of claim 1.

6. A process of fueling a compression ignition internal combustion engine, which process comprises:

drawing air into a cylinder of a compression ignition internal combustion engine;

compressing the air by a compression stroke of a piston in the cylinder;

injecting into the compressed air, toward the end of the compression stroke, a fuel consisting of dimethyl ether, methanol, and water, wherein the percentages thereof, based upon the total weight of dimethyl ether, methanol, and water present, correspond to a composition represented by a location within a trapezoidal region on a triangular phase diagram which is substantially bounded by the shortest line circumscribing points having coordinates (80, 18), (72, 8), (94, 3), and (92, 4) where these coordinates are percent of dimethyl ether and percent of methanol; and igniting the fuel by heat of compression in the cylinder during operation of the compression ignition internal combustion engine.

* * * * *

UNITED STATES PATENT AND TRADEMARK OFFICE
CERTIFICATE OF CORRECTION

PATENT NO.: 5,906,664

DATED: May 25, 1999

INVENTOR(S): Arunabha Basu, Theodore H. Fleisch, Christopher I. McCarthy, Svend-Erik Mikkelson, Carl A. Udovich It is certified that error appears in the above-identified patent and that said Letters Patent is hereby corrected as shown below:

| Col. | Line | |
|---|---|---|
| 1 | 5 | "of U.S. patent"<br><br>should read:<br>"of pending U.S. patent" |
| 6 | 55 | "delineated - for mixtures"<br><br>should read:<br>"delineated for mixtures" |
| 7 | 52 | "monoxide; nitrogen oxides"<br><br>should read:<br>"monoxide, nitrogen oxides" |

UNITED STATES PATENT AND TRADEMARK OFFICE

CERTIFICATE OF CORRECTION

PATENT NO. : 5,906,664

DATED : May 25, 1999

INVENTOR(S) : Arunabha Basu, Theodore H. Fleisch, Christopher I. McCarthy, Svend-Erik Mikkelson, Carl A. Udovich It is certified that error appears in the above-indentified patent and that said Letters Patent is hereby corrected as shown below:

| Col. | Line | |
|---|---|---|
| 7 | 52 | "monoxide; nitrogen oxides"<br>should read:<br>"monoxide, nitrogen oxides" |

Signed and Sealed this

Thirtieth Day of November, 1999

*Attest:*

*Attesting Officer*

Q. TODD DICKINSON

*Acting Commissioner of Patents and Trademarks*